US008938815B2

(12) United States Patent
Vaughn

(10) Patent No.: US 8,938,815 B2
(45) Date of Patent: Jan. 27, 2015

(54) INNER AND OUTER SHORTS WITH A POCKET THEREBETWEEN

(71) Applicant: Jamil Vaughn, San Francisco, CA (US)

(72) Inventor: Jamil Vaughn, San Francisco, CA (US)

(73) Assignee: Jamil Vaughn, San Francisco, CA (US)

( * ) Notice: Subject to any disclaimer, the term of this patent is extended or adjusted under 35 U.S.C. 154(b) by 0 days.

(21) Appl. No.: 13/851,857

(22) Filed: Mar. 27, 2013

(65) Prior Publication Data

US 2013/0283494 A1 Oct. 31, 2013

Related U.S. Application Data

(63) Continuation of application No. 12/075,670, filed on Mar. 13, 2008, now abandoned.

(60) Provisional application No. 60/926,790, filed on Apr. 30, 2007.

(51) Int. Cl.
*A41D 1/08* (2006.01)
*A41D 27/20* (2006.01)

(52) U.S. Cl.
CPC . *A41D 27/20* (2013.01); *A41D 1/08* (2013.01)
USPC ..... 2/238; 2/227; 2/228

(58) Field of Classification Search
CPC ..... A41D 1/06; A41D 1/08; A41D 1/082
USPC ..... 2/69, 228, 250, 247, 465, 22, 238, 466, 2/904, 920, 252, 227, 232, 272, 97, 23, 2/236, 409, 239, 406, 70, 71, 400, 404, 2/407, 234, 403, 79, 338
See application file for complete search history.

(56) References Cited

U.S. PATENT DOCUMENTS

| | | | |
|---|---|---|---|
| 1,397,729 | A | 11/1921 | Franklin |
| 1,409,809 | A | 3/1922 | Zendt et al. |
| 1,721,180 | A | 7/1929 | Falk et al. |
| 2,347,354 | A | 4/1944 | Leubrie |
| 2,458,353 | A | 1/1949 | Decker |
| 2,822,807 | A | 2/1958 | Hayman |
| 3,045,245 | A | 7/1962 | Kohen |
| 3,150,382 | A | 9/1964 | Briley |
| 5,105,473 | A | 4/1992 | Valtakari |
| 5,182,815 | A | 2/1993 | Young |
| 5,255,392 | A | 10/1993 | Stanislaw |

(Continued)

FOREIGN PATENT DOCUMENTS

DE 3638718 8/1987

*Primary Examiner* — Danny Worrell
*Assistant Examiner* — Khaled Annis
(74) *Attorney, Agent, or Firm* — Carol L. Francis; Bozicevic, Field & Francis LLP

(57) ABSTRACT

The invention provides a lower body garment comprising an interior layer comprising an elastic material to be worn around a wearer's leg, an outer shell, and a tunnel pocket system positioned between the outer shell and interior layer. The tunnel pocket system defines a tunnel extending from the exterior pocket of the outer shell and terminating in an interior pocket positioned in or on the elastic material of the interior layer. In use, the wearer can access the interior pocket through the exterior pocket. The elastic material of the interior layer facilitates retention of items stored in the pocket against the wearer's leg, thereby reducing movement of items when the wearer moves. Retention of items stored in the pocket against the wearer's leg can be further enhanced by providing that the pocket be of elastic material.

7 Claims, 6 Drawing Sheets

(56) References Cited

U.S. PATENT DOCUMENTS

| | | | |
|---|---|---|---|
| 5,365,610 | A | 11/1994 | Lubahn et al. |
| 5,497,511 | A | 3/1996 | Zade |
| 5,572,737 | A | 11/1996 | Valice |
| 5,598,586 | A | 2/1997 | Munjone |
| 5,636,377 | A | 6/1997 | Wiener |
| 5,649,328 | A | 7/1997 | Martin |
| 5,918,310 | A | 7/1999 | Farahany |
| 6,189,153 | B1 | 2/2001 | Diamond |
| 6,532,599 | B1 | 3/2003 | Dugan |
| 6,789,270 | B1 | 9/2004 | Pedrick |
| D609,434 | S | 2/2010 | Gunderson |
| 2001/0002493 | A1 | 6/2001 | Wheeler et al. |
| 2005/0000001 | A1 | 1/2005 | Goldkind |
| 2006/0179545 | A1 | 8/2006 | Arensdorf et al. |
| 2007/0067889 | A1 | 3/2007 | Spiewak et al. |
| 2007/0118954 | A1 | 5/2007 | Lee |

INNER AND OUTER SHORTS WITH A POCKET THEREBETWEEN

CROSS-REFERENCE TO RELATED APPLICATION

This application claims the benefit of U.S. provisional application Ser. No. 60/926,790, filed Apr. 30, 2007, which application is incorporated herein by referenced in its entirety.

FIELD OF THE INVENTION

The invention relates to garments having a tunnel pocket system for securing items while wearing the garment.

BACKGROUND

Amateur athletes often find themselves with the opportunity to participate in a sport, but without facilities for safe storage of their valuables. Many opportunities to participate in a sport are in public parks or in remote locations where there are not lockers available. In addition, many sports enthusiasts must be accessible at all times, making it important that they keep their cell phone or pager near them. However, participating in an athletic activity when one has a clunky set of car keys or a phone in a pocket is not only distracting, but can risk loss of personal items or even injury (e.g., from a fall on a pocket containing keys).

There is a need for athletic wear that provides for safe and easy access to personal items, while mitigating interference with participation in an athletic activity.

SUMMARY OF THE INVENTION

The invention provides a lower body garment comprising an interior layer comprising an elastic material to be worn around a wearer's leg, an outer shell, and a tunnel pocket system positioned between the outer shell and interior layer. The tunnel pocket system defines a tunnel extending from the exterior pocket of the outer shell and terminating in an interior pocket positioned in or on the elastic material of the interior layer. In use, the wearer can access the interior pocket through the exterior pocket. The elastic material of the interior layer facilitates retention of items stored in the pocket against the wearer's leg, thereby reducing movement of items when the wearer moves. Retention of items stored in the pocket against the wearer's leg can be further enhanced by providing that the pocket be of elastic material.

Accordingly, in one exemplary aspect, the garment comprises an outer shell of a lower body garment defining a top waist opening and an exterior pocket; an interior layer adapted to be worn around a leg of a wearer and comprising an elastic material; and a tunnel pocket system positioned between the outer shell and the interior layer, wherein the tunnel pocket system defines a tunnel extending from the exterior pocket of the outer shell and terminating in an interior pocket positioned in or on the elastic material of the interior layer.

In related exemplary embodiments, the interior pocket of the garment is composed of an elastic material. In further related exemplary embodiments, the interior pocket is attached on an outer surface of the interior layer. In related exemplary embodiments, the interior pocket is contiguous with the material of the interior layer such that the interior pocket is defined by first and second layers of the interior layer.

In one exemplary embodiment, the interior layer of the garment is an undershort comprising first and second legs. The interior layer can optionally be connected to the outer shell at the waist opening of the outer shell. In a related exemplary embodiments, the pocket tunnel system can be positioned on at least one of a left leg or a right leg of the garment. In related exemplary embodiments, the garment comprises two pocket tunnel systems, wherein a first pocket tunnel system is positioned on a right leg of the garment and a second pocket tunnel system is positioned on a left leg of the garment.

In one exemplary embodiment, the interior layer of the garment is in the form of a sleeve and the tunnel pocket system comprises a tube of material extending from the exterior pocket of the outer shell to the interior layer. In related exemplary embodiments, the sleeve can be a continuous band or a discontinuous band, wherein when a discontinuous band the band comprises at least one fastener for fastening the sleeve around a wearer's leg. In this embodiment, the pocket tunnel system is positioned on at least one of a left leg or a right leg of the garment. In related exemplary embodiments, the garment comprises two pocket tunnel systems, wherein a first pocket tunnel system is positioned to be worn on a right leg of the garment and a second pocket tunnel system is positioned to be worn on a left leg of the garment.

The disclosure further specifically provides a garment in the form of an athletic short comprising an outer shell defining a top waist opening, an exterior pocket, and a pair of bottom leg openings; an interior layer adapted to be worn around a leg of a wearer and comprising an elastic material; and a tunnel pocket system positioned between the outer shell and the interior layer, wherein the tunnel pocket system defines a tunnel extending from the exterior pocket of the outer shell and terminating in an interior pocket positioned in or on the elastic material of the interior layer.

In exemplary embodiments of the athletic short, the interior pocket of the athletic short is composed of an elastic material. In further related exemplary embodiments, the interior pocket is attached on an outer surface of the interior layer. In related exemplary embodiments, the interior layer is a compression short comprising first and second legs. In related exemplary embodiments, the tunnel of the tunnel pocket system is defined by an outer surface of the undershort and a layer of material attached to the outer surface of the undershort. In related exemplary embodiments, the interior layer is connected to the outer shell at the waist opening of the outer shell. In related exemplary embodiments, the athletic short comprises two pocket tunnel systems, wherein a first pocket tunnel system is positioned on a right leg of the garment and a second pocket tunnel system is positioned on a left leg of the garment. In related exemplary embodiments, the athletic short interior layer is in the form of a sleeve and the tunnel pocket system comprises a tube of material extending from the exterior pocket of the outer shell to the interior layer. In related exemplary embodiments, the sleeve of the athletic short is a continuous band or a discontinuous band, wherein when in the form of a discontinuous band it comprises at least one fastener for fastening the sleeve around a wearer's leg.

Garments having the tunnel pocket system disclosed herein provide for secure storage of items such as valuables and personal identification while participating in an activity, while mitigating interference with the ability to participate in the activity. In addition, retention of the items close to the wearer's body decreases the risk of loss (e.g., due to the items falling out of the pocket) or theft (e.g., by a pick-pocketer).

The tunnel pocket system can be adapted for use with a variety of different garments, ranging from sporting goods clothing (e.g., athletic wear, outdoor wear, etc.), travel wear, street wear, etc. Garments having a tunnel pocket system according to the invention include, for example, shorts, pants, skirts, and skorts, and may be a discontinuous or integral portion of an upper body garment, e.g., so as to provide a dress, overalls, jumpsuit, and the like.

These and other features and advantages will be readily apparent to the ordinarily skilled artisan upon reading the present specification.

Figure 1:
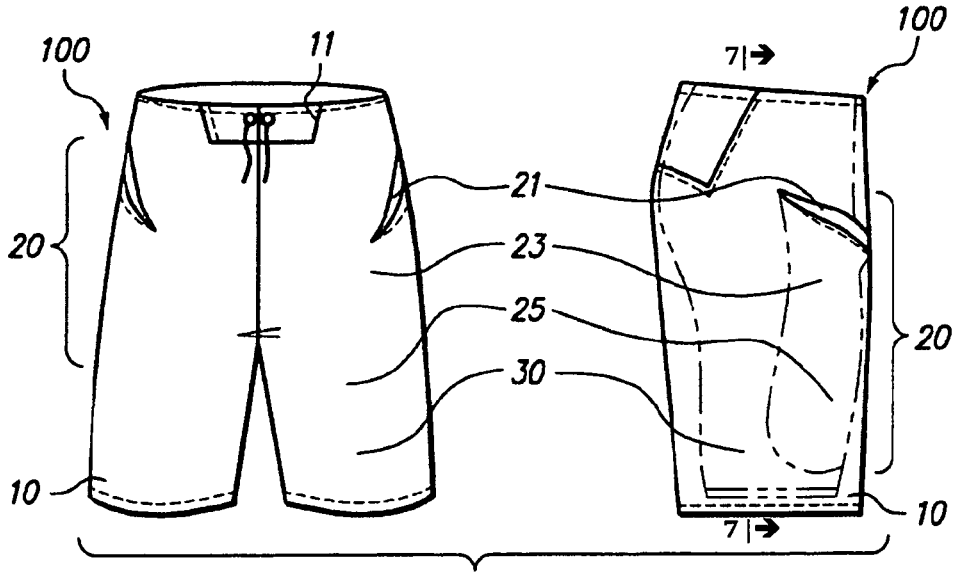
FIG. 1 is a schematic showing a front and side outer view of a garment having two tunnel pocket systems 20, with emphasis on the outer shell 10. Line 7-7 denotes cross section shown in FIG. 7.

Before the present invention is further described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice of the present invention, exemplary methods and materials are now described. All publications mentioned herein are incorporated herein by reference to disclose and describe the methods and/or materials in connection with which the publications are cited.

It must be noted that as used herein and in the appended claims, the singular forms "a", "and", and "the" include plural referents unless the context clearly dictates otherwise. Thus, for example, reference to "a pocket" includes a plurality of such pockets and reference to "the garment" includes reference to one or more garments, and so forth. The invention will now be described in more detail.

DETAILED DESCRIPTION OF EXEMPLARY EMBODIMENTS OF THE INVENTION

In general, the invention provides a lower body garment comprising a tunnel pocket system. The lower body garment comprises an outer shell and an interior layer, the latter of which comprises an elastic material. The tunnel pocket system connects the outer shell and the interior layer so as to define a tunnel extending from the exterior pocket of the outer shell and terminating in an interior pocket positioned in or on the elastic material of the interior layer.

In one embodiment, the interior layer is in the forth of a sleeve that is sized for wearing around a person's thigh. In this embodiment, the tunnel pocket system can comprise a tube of material extending from the exterior pocket of the outer shell to the interior layer. The sleeve may be provided as a continuous band comprising elastic material to be positioned around a thigh of the wearer. Alternatively, the interior layer may be provided as a discontinuous band of material that can be fastened around the leg and held in place, e.g., by use of VELCRO™, hooks, etc.

In another embodiment, the interior layer is provided in the form of a short, e.g., a compression short. In this embodiment, the tunnel of the tunnel pocket system can be defined by an outer surface of the undershort and a single layer of material that is attached to the outer surface of the undershort. For example, the tunnel of the tunnel pocket system can be defined by a layer of material that extends from an interior pocket (which can be defined by the undershort outer surface and the layer of material) along the undershort outer surface to the exterior pocket of the outer shell.

The garment can include one tunnel pocket system, which can be positioned on the right or left leg of the wearer.

The outer shell may be in the form a short, pant, skirt, or skort, and may be a discontinuous or integral part of an upper body garment (e.g., a dress, jumpsuit, etc.). The outer shell and interior layer may be optionally attached at a waistband.

In use, a person wearing the garment can access the interior pocket positioned at the interior layer through the exterior pocket to store and/or remove stored items from the interior pocket. The elastic material of the interior layer facilitates retention of items stored in the pocket against the wearer's leg, thereby reducing movement of items when the wearer moves. Retention of items stored in the pocket against the wearer's leg can be further enhanced by providing that the pocket be of the same or different elastic material. The pocket can be of any suitable size, and may be positioned at any location on the interior layer, e.g., so as to be positioned at the side of the wearer's leg, on a front portion of the wearer's leg, etc.

Further details and exemplary embodiments of the invention are described below.

Outer Shell

As noted above, the outer shell of the garment of the invention can be in the form of any lower body exterior garment of interest such as shorts, pants, skirt, skirt, skort, and the like. The outer shell can optionally be provided as a continuous or discontinuous portion of a larger garment, such as a dress, overalls, jumpsuit, and the like. The outer shell can be optionally detachable from the interior layer.

Of particular interest are garments that have an outer shell that is loose fitting on the wearer, so as to provide for mobility of the wearer.

The outer shell generally defines a top waist opening and an exterior pocket. In use, the interior pocket of the tunnel pocket system is accessed through the exterior pocket defined by the outer shell. The exterior pocket may optionally include a closure, such as VELCRO™, one or more snaps, one or more buttons, and the like.

The material of the outer shell can be selected from any of a variety of suitable materials. In general, the material is selected according to the use for which the garment is intended, e.g., sporting activities (e.g., athletic activities (e.g., basketball, baseball, tennis, lacrosse, football, field hockey, volleyball, cycling, surfing, running, jogging, skating, etc.), outdoor activities (e.g., hiking, rock climbing, skateboarding, mountaineering, etc.), travel, and the like. It may be desirable that the outer layer be composed of a material that is one or more of lightweight, breathable, moisture-wicking, stain-resistant, water-resistant, and combinations thereof. It is also generally desirable the outer layer material be washable, especially machine-washable. Examples of materials include, but are not limited to, LYCRA®, SPANDEX®, COOLMAX®, polypropylene, NYLOUR®, and the like. The outer shell may be double-sided (e.g., so as to provide different desired characteristics on an inner side compared to an outer side, e.g., water-resistant on an outer side).

The waist opening of the outer shell can comprise any of a variety of suitable closure devices (e.g., drawstring, snap, zipper, etc.) and/or can include elastic to provide for a desired fit around the waist of the user.

Interior Layer

The interior layer (also referred to as an "inner shell" in some embodiments) can be of at least two general embodiments. In one, the inner shell is provided as a sleeve that fits around a wearer's leg when in use. In a second embodiment, the inner shell is in the form of an undershort, such as a compression short. In either embodiment, the interior layer is of an elastic, conformable material that holds the interior layer and the interior pocket of the tunnel pocket system, close to the wearer's body.

It is generally desirable that the material of the interior layer be breathable and lightweight. It is also generally desirable the interior layer material also be washable, especially machine washable. In some embodiments, particularly those in which the interior layer is an undershort, the material is of sufficient elastic strength such that the interior layer material can provide for one or more of maintenance of muscle warmth (e.g., to reduce the risk of muscle strain or pulls), prevention of chafing and/or rashes, and wicking away of sweat from the body. The interior layer material may also have other characteristics such as, but not limited to moisture-wicking, stain-resistant, water-resistant, and combinations thereof. Examples of elastic material for the interior layer include, but are not necessarily limited to, SPANDEX™, LYRCA™, COOLMAX®, polypropylene, NYLOUR®, and the like. The interior layer may be double-sided (e.g., so as to provide different desired characteristics on an inner side in contact with the wearer's body compared to an outer side, e.g., water-resistant on an outer side).

Where the inner shell is in the form of a sleeve, the sleeve is sized for wearing around the wearer's thigh. The sleeve may be provided as a continuous band comprising elastic material to be positioned around a thigh of the wearer. Alternatively, the interior layer may be provided as a discontinuous band of material that can be fastened around the leg and held in place, e.g., by use of VELCRO™, hooks, etc. In another embodiment, the interior layer is provided in the form of a short, e.g., a compression short. The garment can include one tunnel pocket system, which can be positioned on the right or left leg of the wearer. Optionally, the sleeve-style interior layer can be attached to the outer shell, e.g., at an outer side seam of the outer shell.

Where the inner shell comprises a sleeve, stabilizers may be optionally attached to the outside seams of the interior layer and/or outer shell where attached to the inner seams of the outer shell. The stabilizers can be adapted to facilitate retention of the interior pocket when items are inserted into and/or removed from the pocket(s).

Where the inner shell is in the form of an undershort, the inner shell generally defines a waist opening and a pair of bottom leg openings. The inner shell in this embodiment can extend up to and optionally including the waist and extend to at least the mid or lower thigh. The undershort can include multiple panels to provide for maximum movement of the user, as may be standard in the industry.

Where the interior layer extends to the waist of the wearer (e.g., where the interior layer is in the form of an undershort, such as a compression short, the interior layer may be optionally attached to the outer shell at the waistband of the garment. The waist opening of the inner shell can be attached to the waist opening of the outer shell such that a single closure can be used for both the inner and outer shells.

In one embodiment, the inner shell has a closure that is separate from any closure that may be provide in the outer shell. In this embodiment, the inner shell is attached at the waist opening of the outer shell so that the closure of the outer shell is accessible, e.g., the inner shell is not attached to the outer shell at a front portion of the garment, so as to provide access to the inner shell closure. The inner shell closure can comprise any of a variety of suitable closure devices (e.g., drawstring, snap, etc.) and/or can include elastic to provide for a desired fit around the waist of the user.

Of particular interest is the combination of a loose-fitting outer shell (e.g., in the form of a pant, short, skirt or skort) having an elastic waistband, with an inner shell of a compression short, with the inner shell attached to the outer shell at the waist. In this embodiment, the outer shell includes an optional drawstring closure.

Generally, where the inner shell is in the form of an undershort, the legs of the inner shell are of a length such that, when the wearer is standing still, the inner shell legs are not visible due to the presence of the outer shell. For example, the length of the outer shell legs, or the length of the outer shell skirt, is greater than the length of the inner shell legs.

Tunnel Pocket System

As discussed above, the tunnel pocket system generally is positioned between the outer shell and the interior layer so as to define a tunnel between the opening of the exterior pocket of the outer shell and an interior pocket defined on or in the interior layer.

The tunnel pocket system can take a variety of forms, and can be adapted according to the interior layer embodiment employed. For example, where the interior layer is a sleeve that is adapted to be worn around the leg (e.g., mid- to lower thigh) of the user, the tunnel pocket system comprises a tube of material extending from an opening of the exterior pocket of the outer shell to the interior layer (sometimes referred to as the "tunnel"), so as to terminate in an interior pocket in or on the interior layer. The interior pocket of the tunnel pocket system can be attached to or contiguous with the elastic interior layer. For example, the interior pocket can be defined an outer surface of the sleeve and a layer of material extending from the tube of material of the tunnel pocket system, or can be provided within first and second layers of the interior layer.

Where the interior layer is an undershort, the tunnel of the tunnel pocket system can be defined by an outer surface of the undershort and a layer of material that is attached to the outer surface of the undershort. For example, the tunnel of the tunnel pocket system can be defined by a layer of material that extends from an interior pocket (which can be defined by the undershort outer surface and the layer of material, or can be provided within first and second layers of the interior layer) along the undershort outer surface to an opening of the exterior pocket of the outer shell.

The tunnel pocket system can be composed of the same material throughout its length, or can be composed of different materials, particularly so as to provide that the material defining the interior pocket is composed of an elastic material to facilitate retention of items stored in the pocket at a position on the wearer's leg. For example, where the tunnel pocket system provides for connection of an outer shell exterior pocket and an interior layer in the form of a sleeve, the tunnel pocket system can comprise a tube made of a first material that terminates in an interior pocket made of a second material, where the second material can be elastic. The first material can be any suitable material, although if elastic, usually a material not as stiff as the elastic material of the interior pocket. In general, it may be desirable to construct the tunnel pocket material from a material that is the same or similar to that of the interior layer.

The interior pocket of the tunnel pocket system can include additional padding. For example, the side of the interior pocket adjacent the wearer's body can be composed of a thicker material and/or can include a padding layer so as to facilitate protection of the wearer's body from injury from an item that may be stored in the interior pocket. It may also be desirable to include a padding layer on the side of the interior pocket opposite the wearer's leg, so as to facilitate protection of items in the pocket and/or to decrease risk of injury to others who may collide with the wearer on a side of the garment that holds the stored item.

The interior pocket of the tunnel pocket system can provide for a single continuous pocket, or can be divided into two or more separable subpockets. For example, a first subpocket can be positioned closer to the exterior layer with a second subpocket positioned closer to the interior layer near the bottom of the interior pocket. The first and second subpockets can be separated by a closure mechanism, such as a drawstring or VELCRO® closure. The closure mechanism can be accessed from inside the interior pocket, from the exterior of the interior layer, or both. For example, where the closure mechanism for a subpocket is accessible from the exterior of the interior layer, the closure mechanism can be in the form for a drawstring that is secured on an exterior side of the interior layer. The subpockets can be used to separate items stored in the tunnel pocket system in terms of their value and or frequency of use. For example, more valuable items (e.g., wallet, large bills, passport, and the like) can be secured in a deeper subpocket, while more frequently used items (e.g., smaller bills, hotel keys, car keys, tickets) can be stored in subpocket located closer to the outer shell for more ready access by they user.

The tunnel pocket system can be constructed in multiple ways. For example, the tunnel and interior pocket components can be provided as a continuous piece of material, or may be provided as separate pocket and tunnel components that are stitched together.

In use, a person wearing the garment can access the interior pocket (which may optionally be divided into subpockets) positioned at the interior layer through the exterior pocket to store and/or remove stored items from the interior pocket. The elastic material of the interior layer facilitates retention of items stored in the pocket against the wearer's leg, thereby reducing movement of items when the wearer moves. Retention of items stored in the pocket against the wearer's leg can be further enhanced by providing that the pocket be of the same or different elastic material. The pocket can be of any suitable size, and may be positioned at any location on the interior layer and at any position on a circumference of the wearer's body (e.g., so as to be positioned at the side, front, or back portion of the wearer's leg, on or as an extension of a back pocket, front portion of the wearer's leg, etc.) with the proviso that the position is provided so as to be compatible with the function and use to which the garment is to be applied. For example, where the garment is to be worn for participation in a contact sport, it may be desirable to position the pocket to as to decrease risk one or more of interference with the wearer's mobility, risk of injury to the wearer or others participating in the activity, and/or damage to the contents of the pocket.

Exemplary Garments Having a Tunnel Pocket System

Figure 2:
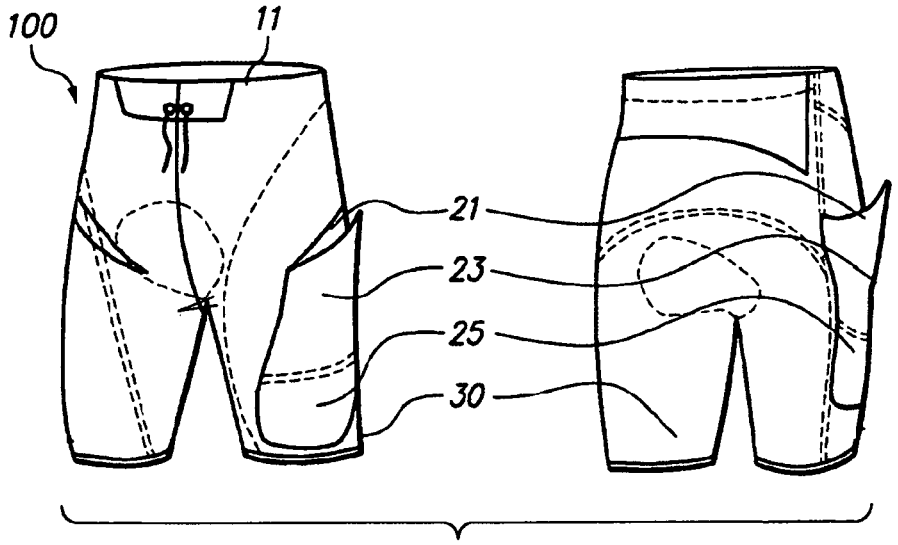
FIG. 2 is a schematic showing front and back view of an interior layer 30 that is a compression short, exemplified by an athletic short, having a single tunnel pocket system 20.
Figure 7:
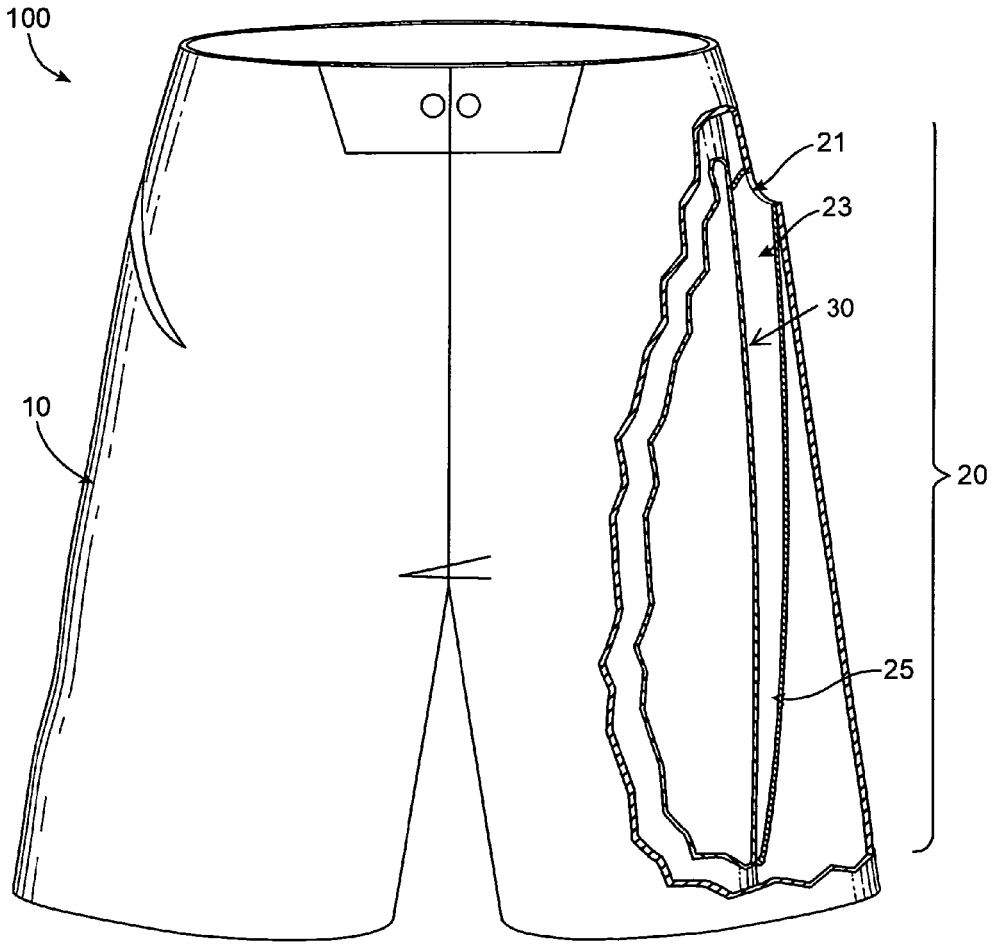
FIG. 7 is an enlarged cross sectional view taken along line 7-7 of FIG. 1, showing a tunnel 23 of a tunnel pocket system 20 defined by an outer surface of the interior layer 30 and a layer of material that is attached to the outer surface of the undershort. For example, the tunnel of the tunnel pocket system can be defined by a layer of material that extends from an interior pocket (which can be defined by the undershort outer surface and the layer of material, or can be provided within first and second layers of the interior layer) along the undershort outer surface to an opening of the exterior pocket of the outer shell.

FIG. 1 is a schematic showing a front and side outer view; exterior (bold print), interior (light print) of a garment 100 having two tunnel pocket systems 20, with emphasis on the outer shell 10. FIG. 2 is a schematic showing front and back view; exemplified by an athletic short of an interior layer 30 that is a compression short, having a single tunnel pocket system 20. FIG. 7 provides a cross-section of the tunnel pocket system 20 of FIG. 1.

Exterior pocket 21 appears as normal exterior pocket openings, here exemplified as being located on shorts or pants bottoms of any style. This pocket opening can be cut or shaped in any fashion; horizontal slit, vertical side seam slit, frontal basket cup, etc. The exterior pocket should be of a size and shape so as to allow objects to pass through the opening of exterior pocket 21. However, instead of resting in a traditional style pocket, these items will enter a tunnel-like section referred to as the tunnel 23 of the tunnel pocket system 20. The tunnel 23 is located between the outer shell 10 (which can be, for example, any style pant or short bottom) and interior layer 30 (exemplified in this Figure as a compression style inner lining). FIG. 1 illustrates the functional relationship between the outer shell 10 and interior layer 30 provided by the tunnel pocket system 20. The tunnel pocket system 20 is connected to the outer shell 10 at the opening of exterior pocket 21 from the inside. Tunnel 23 continues on to connect to an interior pocket 25 that in this example is composed of a formfitting and expandable material located on interior layer 30, exemplified here by a compression style underlining The tunnel pocket system 20 in the example of FIG. 1 is a flexible and tubular section of material (e.g., made from SPANDEX™ or LYCRA™). The tunnel 23 functions as a coupling device allowing passage of personal items into a secure, expandable, and formfitting interior pocket 25. The interior pocket 25 is located on a interior layer 30, exemplified by a compression style inner-lining. Expandable and formfitting interior pocket 25 secures its contents against the body, thus enhancing comfort, convenience, and safety during vigorous physical activity. Furthermore, interior pocket 25 affords the product a greater degree of protection against loss and theft of personal belongings.

Interior layer 30 can be adapted from any of a variety of supportive, non-visible, under-girdles and can be attached to an outer shell 10 adapted from any of a variety of styles of garments, such as shorts, or pants).

Figure 3:
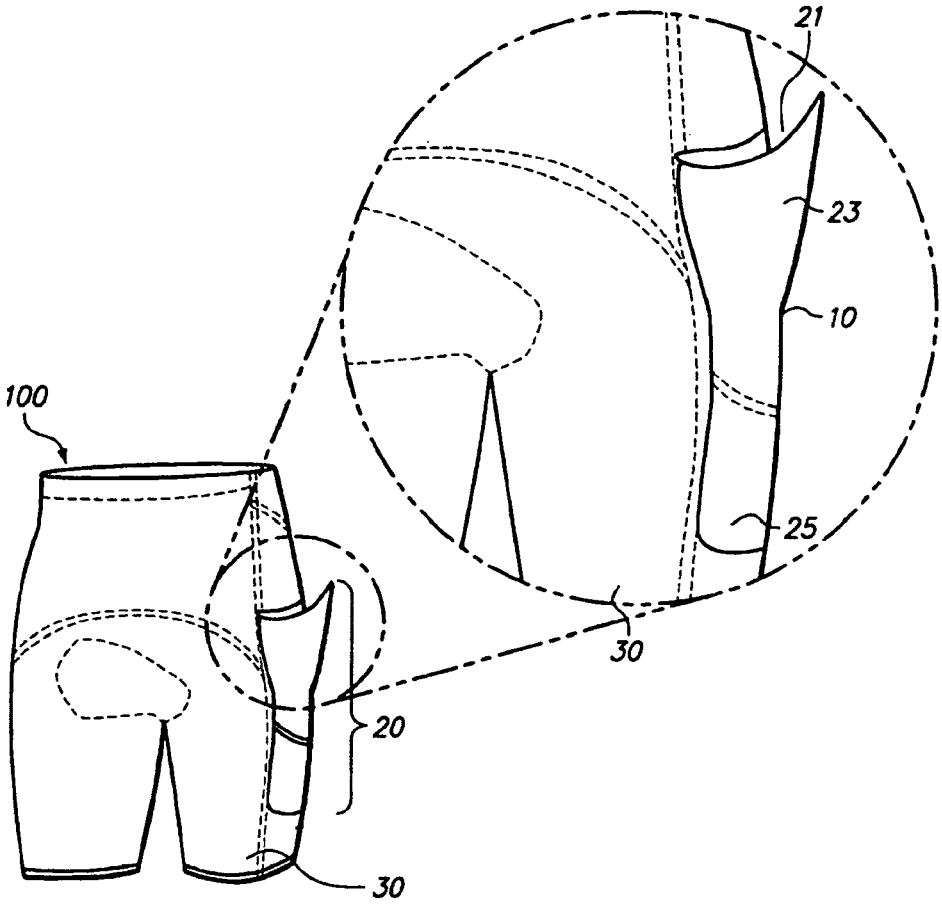
FIGS. 3 and 4 are additional schematics providing a side/back view (FIG. 3) and front view (FIG. 4) of a garment having a single tunnel pocket system 20, which is exemplified by an athletic short.
Figure 4:
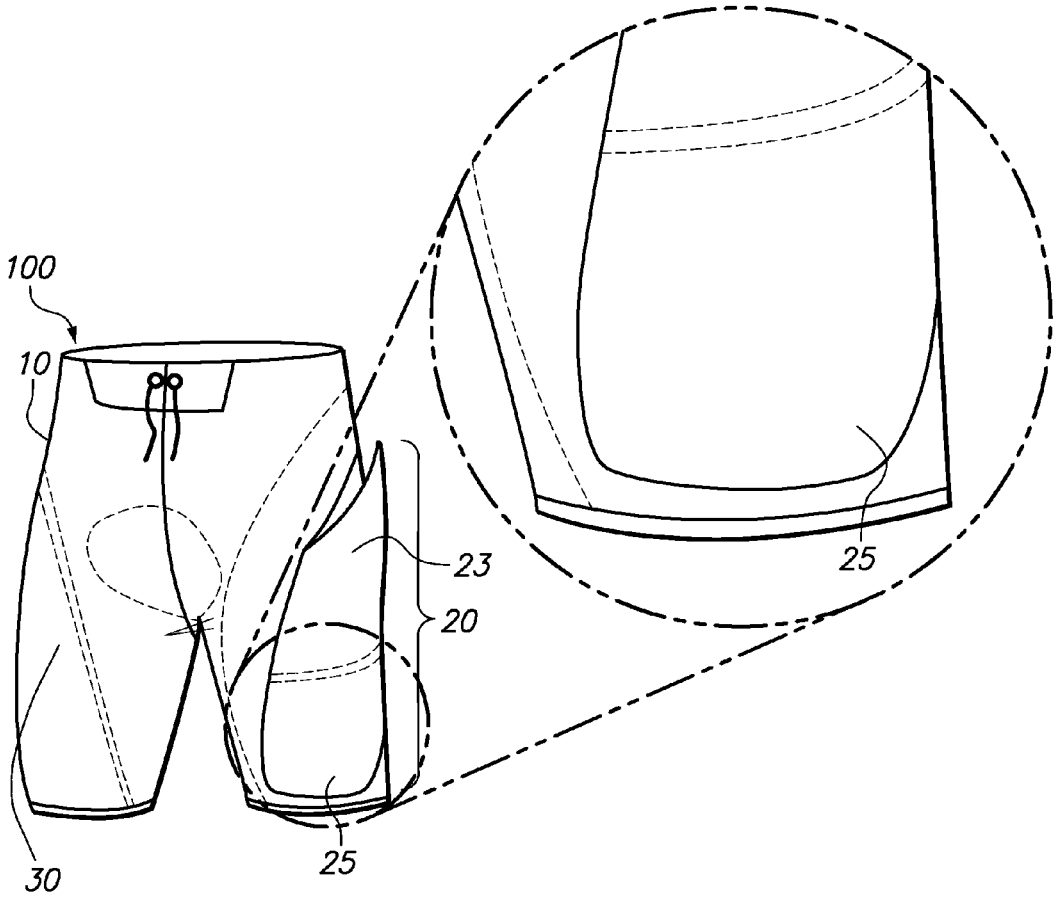

FIGS. 3 and 4 are additional schematics providing a side/back view (FIG. 3) and front view (FIG. 4) of a garment having a single pocket tunnel system 20, which is exemplified by an athletic short.

Figure 5:
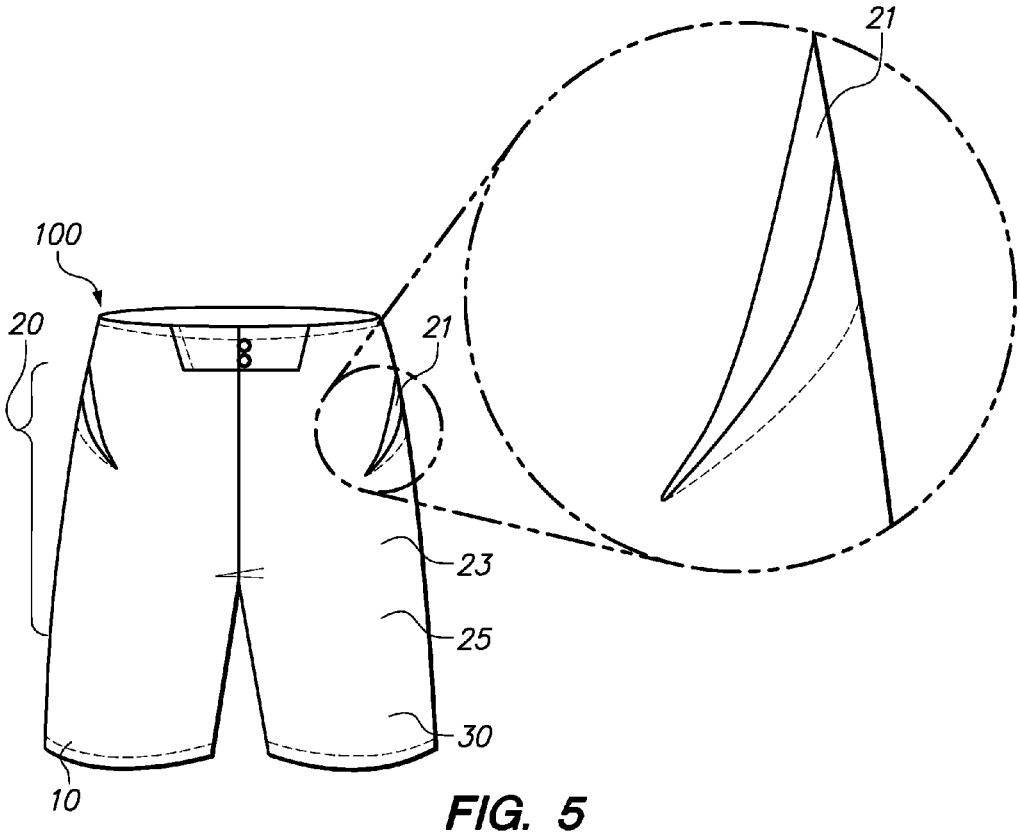
FIG. 5 is an additional schematic providing a front view (with emphasis on the outer shell 10) of a garment having two tunnel pocket systems 20, which is exemplified by an athletic short.

FIG. 5 is an additional schematic providing a front view (with emphasis on the outer shell 10) of a garment having two pocket tunnel systems 20, which is exemplified by an athletic short.

Figure 6:
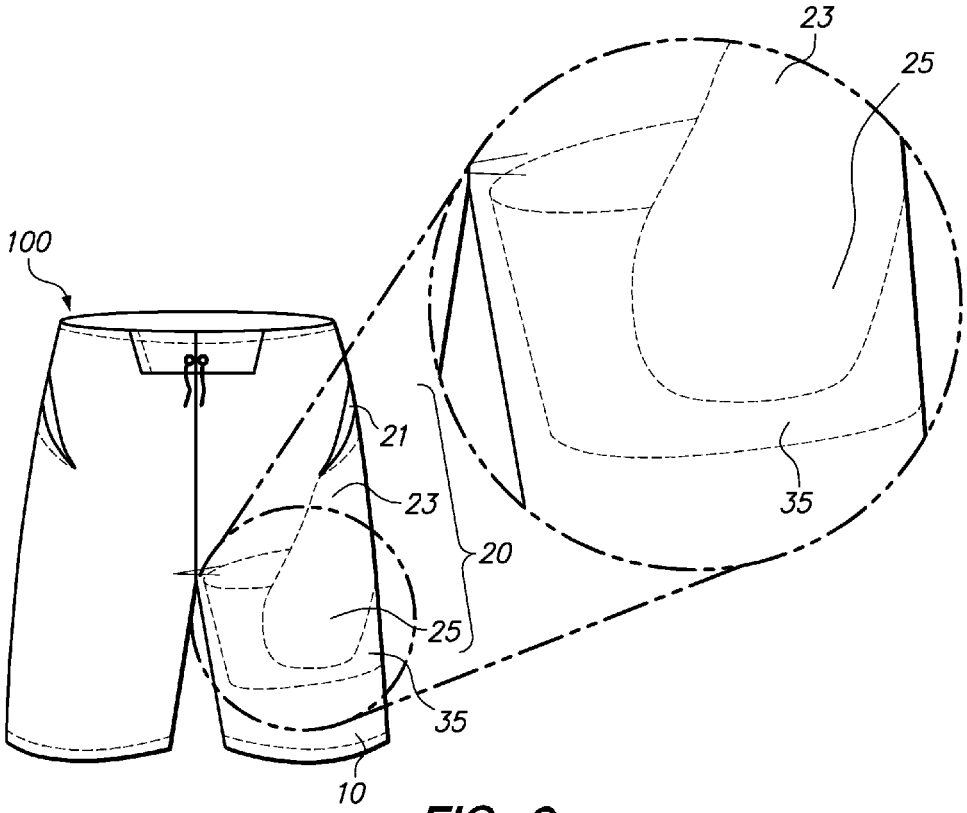
FIG. 6 is a schematic of garment, exemplified by an athletic short, having a tunnel pocket system 20, where pocket 25 is located in an expandable sleeve 35.

FIG. 6 is a schematic of garment, exemplified by an athletic short, having a tunnel pocket system 20, where pocket 25 is located in an expandable sleeve 35. In this embodiment, the sleeve-style interior layer 35 provides for placement of interior pocket 25. In this example, the interior pocket 25 is located on an expandable leg sleeve as opposed to its location on a compression style underlining, depicted in FIGS. 1 and 2. In this embodiment, sleeve-style interior layer 35 is attached to outer shell 10 at an inner side seam of the outer shell. This embodiment of the garment provides wearers with increased ventilation and a less restrictive fit.

What is claimed is:

1. A garment comprising:

an outer shell of a pair of shorts defining a top waist opening and an exterior pocket opening;

a interior, elastic shorts comprising first and second leg panels designed to be worn around the legs of a wearer; and a tunnel pocket system comprising a single layer of elastic material attached to the exterior pocket opening and an outer surface of one of the first or second leg panels of the interior elastic shorts, wherein the single layer of elastic material and the outer surface of the interior elastic shorts adjacent to the single layer define a tunnel extending from the exterior pocket opening of the outer shell and terminating on the outer surface of the one of the first or second leg panels of the inner elastic shorts.

2. The garment of claim 1, wherein the interior elastic shorts are connected to the outer shell at the waist opening of the outer shell.

3. The garment of claim 1, wherein the tunnel pocket system is positioned on the first leg panel of the interior elastic shorts.

4. The garment of claim 1, wherein the garment comprises two tunnel pocket systems, wherein a first tunnel pocket system is positioned on the first leg panel of the interior elastic shorts and a second tunnel pocket system is positioned on the second leg panel of the interior elastic shorts.

5. An athletic short comprising:

an outer shell defining a top waist opening, an exterior pocket opening, and a pair of leg panels having bottom leg openings;

a compression short comprising an elastic material, and comprising first and second leg panels designed to be worn around the legs of a wearer; and a tunnel pocket system comprising a single layer of elastic material attached to the exterior pocket opening and an outer surface of one of the first or second leg panels of the compression short, wherein the single layer of elastic material and the outer surface of the compression short adjacent to the single layer define a tunnel extending from the exterior pocket opening of the outer shell and terminating on an outer surface of one of the first or second leg panels of the elastic material of the compression short.

6. The athletic short of claim 5, wherein the compression short is connected to the outer shell at the waist opening of the outer shell.

7. The athletic short of claim 5, wherein the garment comprises two tunnel pocket systems, wherein a first pocket tunnel system is positioned on the first leg panel of the compression short and a second pocket tunnel system is positioned on the second leg panel of the compression short.

* * * * *